United States Patent [19]

Farah

[11] Patent Number: 4,881,278

[45] Date of Patent: Nov. 21, 1989

[54] COMBINATION PACKAGE FOR DISINFECTING AND COVERING TOILET SEAT

[76] Inventor: Khaled S. Farah, 1512 W. Chalgrove, Corona, Calif. 91720

[21] Appl. No.: 141,835

[22] Filed: Jan. 11, 1988

[51] Int. Cl.[4] ..... A47K 13/14

[52] U.S. Cl. ..... 4/243; 206/209; 206/361; 206/812

[58] Field of Search ..... 4/242, 243, 233; 206/484, 812, 209, 210, 361; 15/104.94

[56] References Cited

U.S. PATENT DOCUMENTS 3,240,326 3/1966 Miller ..... 206/812 X
3,889,804 6/1975 Ravich ..... 206/812 X

FOREIGN PATENT DOCUMENTS 2914590 10/1980 Fed. Rep. of Germany ..... 206/812
0656518 7/1986 Switzerland ..... 4/243

*Primary Examiner*—Charles E. Phillips
*Attorney, Agent, or Firm*—Fulwider, Patton, Rieber, Lee & Utecht

[57] ABSTRACT

A single-use unitary package for carrying toilet seat disinfecting/covering materials on the person. The package is constructed of flexible sheet material such as aluminum foil, sealed along edges and across the middle to form two compartments. One compartment holds a folded toilet seat cover and the other compartment holds a supply of toilet seat disinfectant.

1 Claim, 1 Drawing Sheet

COMBINATION PACKAGE FOR DISINFECTING AND COVERING TOILET SEAT

This invention relates to a personal hygiene product.

More particularly, the invention concerns a single-use unitary package for carrying a toilet seat cover and a supply of disinfectant on the person, e.g., in the pocket or in a lady's handbag.

Even more particularly, the invention relates to such a package which is opened sequentially, with the portion of the package containing the toilet seat forming a convenient handle for applying the disinfectant in the first-opened portion of the package to the toilet seat.

Conventional toilet seat covers comprise a sheet of tissue paper or other suitable thin material, shaped and dimensioned to overlie the seat portion of a conventional toilet, to protect against contact between the user's body and the seat. Such covers are dispensed to the public from wall-mounted holders in some, but not nearly all, public toilet facilities.

Single-use packages containing disinfecting or cleaning materials are also known. Such packages are sometimes dispensed to the public for hand cleaning, e.g., along with meals on commercial aircraft, etc.

Until now, however, no means have been provided to enable a person to conveniently carry disposable materials for cleaning and covering toilet seats in public restroom facilities, in single-use, easily-opened, conveniently-sized packages. With increased public awareness of the possibility of contracting communicable diseases carried in body fluids, the desirability of such a product has substantially increased.

Accordingly, the principal object of the present invention is to provide a personal hygiene product comprising a single-use unitary package for carrying a disposable toilet seat cover and a supply of disinfectant.

Yet another object of the invention is to provide such a package which is conveniently sized and shaped to be carried on the person.

Still another object of the invention is to provide such packaged product which can be easily opened by hand and in which a portion of the package serves as a convenient handle for grasping the package while liquid or semi-liquid disinfectant is being applied to the toilet seat, without getting the disinfectant on the hands of the user.

Figure 1:
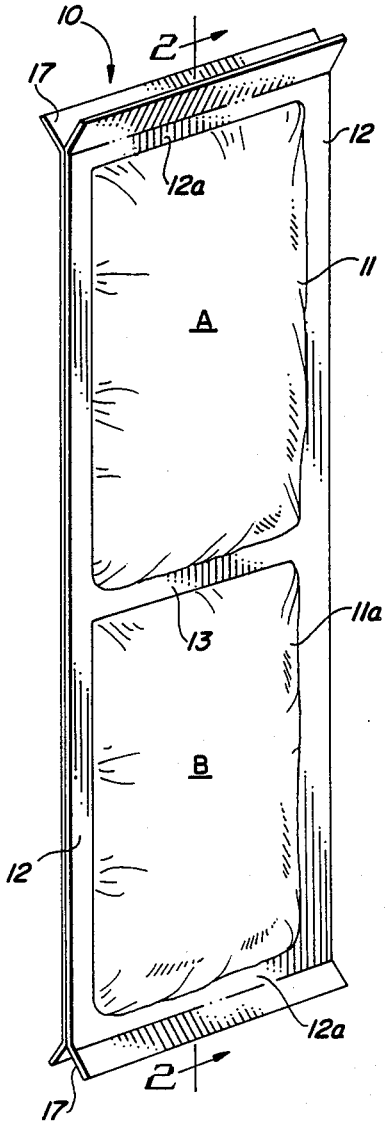
Figure 2:
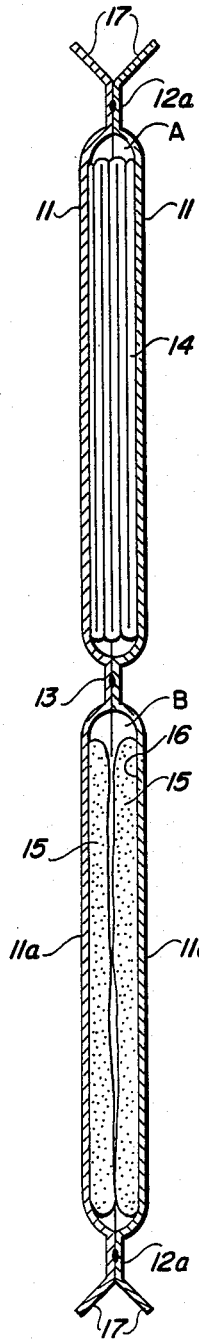
Figure 3:
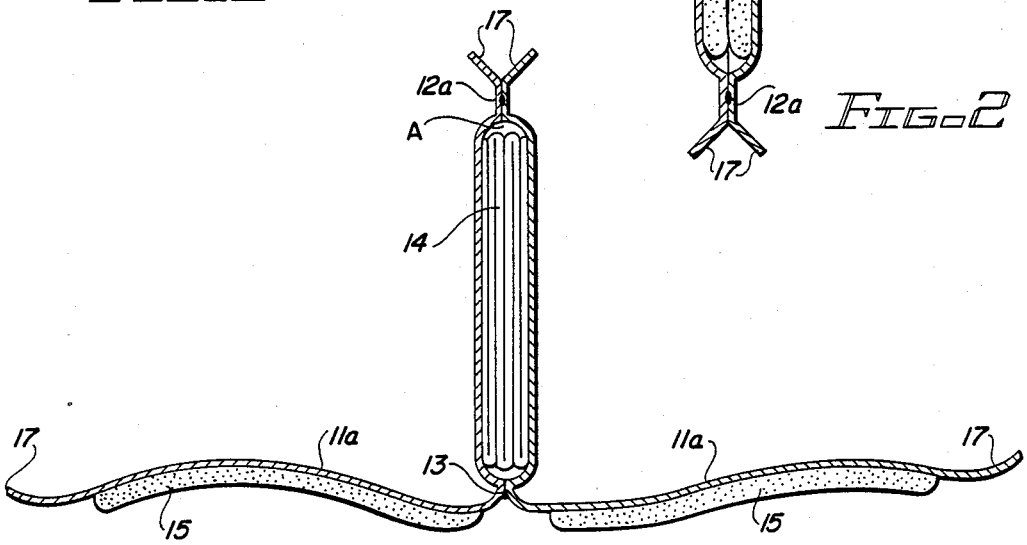

These, other and further and more specific objects and advantages of the invention will be apparent to those skilled in the art, from the following detailed description thereof, taken in conjunction with the drawings in which:

FIG. 1 is a perspective view of a single-use unitary package, constructed in accordance with the principles of the invention;

FIG. 2 is a sectional view of the package of FIG. 1, taken along section line 2—2 thereof, showing a folded toilet seat cover contained in the upper compartment of the package and an absorbent pad impregnated with a liquid disinfectant in the lower compartment of the package; and FIG. 3 is a sectional view of the package of FIGS. 1–2, showing the lower compartment opened to expose the disinfecting pad in position for application of the disinfectant to a toilet seat.

Briefly, in accordance with the invention, I provide a single-use unitary package for carrying toilet seat disinfecting/covering materials on the person.

The package and contents are conveniently constructed for using and dispensing the materials by hand without touching the toilet set and without getting disinfectant on the user's hands. The package comprises flexible, liquid-proof opposed sheets, sealed together along opposed peripheral edges and along a line between two opposite ends thereof, to form two separate liquid-tight compartments. A folded toilet seat cover is disposed in one of the compartments and a toilet seat disinfectant is disposed in the other of the compartments.

Turning now to the drawings, in which like reference characters identify the same elements in the several views, as shown in FIGS. 1–2, flexible sheets 11 of a suitable flexible liquid-proof material, e.g., aluminum foil, mylar, plastic-impregnated or coated paper or the like, are sealed along opposed peripheral edges 12, e.g., by adhesive, heat sealing, etc. The sheets are also sealed along line 13 intermediate opposite ends of the package to form separate liquid-tight compartments A and B. Optionally, ends 17 of the sheets 11 extend beyond the end seals **12*a* forming tabs which can be easily grasped by the fingers to open both the upper and lower compartments by breaking or tearing the seals 12*a***.

In use, the package compartments A and B are opened sequentially as shown in FIG. 3. The lower compartment B containing absorbent pad material 15, adhesively or otherwise secured to the inner surfaces of sheets **11*a*, is opened first and the sheets 11*a* are spread apart to form a disinfecting pad which can be conveniently grasped by the upstanding compartment A and manipulated to apply a liquid or semi-liquid disinfectant impregnated into the pad 15**, to the toilet seat.

Thereafter, the upper compartment A is opened by grasping the tab 17 and pulling the sheets 11 apart at the seal 12. The folded toilet seat cover 14 can then be extracted from the opened upper compartment A and placed on the toilet seat.

Having described my invention in such terms as to enable those skilled in the art to understand and practice it and having identified and described the presently preferred embodiment thereof, I claim:

1. A single-use unitary package for carrying toilet seat disinfecting/covering materials on the person and for conveniently using and dispensing such materials, said package comprising, in combination:

(a) flexible, liquid-proof opposed sheets, releasably sealed together along opposed peripheral edges and along a line between two opposite ends thereof, to form two separately openable liquid-tight compartments having inner opposed faces;

(b) a dry toilet seat cover in a first one of said compartments; and (c) a toilet seat disinfectant -impregnated pad material secured to the inner opposed faces of said sheets in the other of said compartments, said first compartment, while unopened, forming a handle for grasping said package with said other compartment opened and said pad material exposed for disinfecting wiping off said toilet seat.

* * * * *